United States Patent [19]

Schwartz et al.

[11] Patent Number: 5,033,740

[45] Date of Patent: Jul. 23, 1991

[54] APPARATUS FOR EXERCISING THAT IS USED WITH A HAND

[75] Inventors: Leonard Schwartz, 5526 Northumberland St., Pittsburgh, Pa. 15217; Donald Ericksen, Broadalbin, N.Y.

[73] Assignee: Leonard Schwartz, Pittsburgh, Pa.

[21] Appl. No.: 616,764

[22] Filed: Nov. 16, 1990

Related U.S. Application Data

[63] Continuation of Ser. No. 430,662, Nov. 10, 1989, abandoned.

[51] Int. Cl.[5] ..... A63B 21/065

[52] U.S. Cl. ..... 272/119; 272/122

[58] Field of Search ..... 272/67, 68, 116, 117, 272/119, 122, 123, 143; 280/821, 822; 16/124, 125, 126, 127; 273/165, 166; 294/168, 169, 170

[56] References Cited

U.S. PATENT DOCUMENTS

| | | | |
|---|---|---|---|
| 1,536,048 | 5/1925 | Alastalo | 202/122 |
| 2,672,103 | 3/1954 | Hohmes | 16/126 |
| 2,812,206 | 11/1957 | Brunn | 294/170 X |
| 3,184,101 | 5/1965 | Pentesco | 16/125 X |
| 3,992,021 | 11/1976 | Tobin | 273/166 X |
| 4,361,324 | 11/1982 | Baroi | 272/122 X |
| 4,627,618 | 12/1986 | Schwartz | 272/122 |
| 4,720,098 | 1/1988 | Gordon | 272/122 |
| 4,722,523 | 2/1988 | Yang | 272/122 |
| 4,743,017 | 5/1988 | Jaeger | 272/143 X |
| 4,768,780 | 9/1988 | Hayes | 272/122 |
| 4,778,173 | 10/1988 | Joutras | 272/122 X |
| 4,787,624 | 11/1988 | Grant | 272/122 X |
| 4,813,669 | 3/1989 | Caruthers | 272/122 |

FOREIGN PATENT DOCUMENTS

| | | | |
|---|---|---|---|
| 2159061 | 11/1985 | United Kingdom | 272/122 |

*Primary Examiner*—Robert Bahr

*Attorney, Agent, or Firm*—Ansel M. Schwartz

[57] ABSTRACT

An apparatus for exercising. The apparatus comprises a first portion having a predetermined weight. The first portion is grippable by a hand and has a first end and a second end. The apparatus is also comprised of N second essentially rigid portions connected to the first portion such that the N openings are defined by the first portion and the N second portions where $N \geqq 1$. The N openings are each capable of receiving a hand in a manner that essentially does not affect blood pressure or blood circulation through the hand. The first portion is disposed with respect to the front of the hand and the second portion is disposed with respect to the back of the hand. An exerciser uses the apparatus by placing his hand through the opening and gripping the first portion. When, for instance, the exerciser swings his arm, the second portion that is disposed with respect to the back of the hand facilitates the exerciser maintaining a grip on the first portion without having to grip it tightly while moving the arm during exercise.

11 Claims, 3 Drawing Sheets

APPARATUS FOR EXERCISING THAT IS USED WITH A HAND

This is a continuation of copending application(s) Ser. No. 07/430,662 filed on Nov. 10, 1989, now abandoned.

FIELD OF THE INVENTION

The present invention is related to exercise equipment. More specifically, the present invention relates to an apparatus for exercising that is used with a hand.

BACKGROUND OF THE INVENTION

The Heavyhands strength endurance exercise system, described in the books "Heavyhands Walking" and "The Heavyhands Walking Book!" both by Leonard Schwartz, utilizes a weight that is held in an exerciser's hand. The weight has a strap that fits across the back of the hand and facilitates the exerciser holding the hand weight while the exerciser moves his arm in a prescribed fashion. Ideally, the strap only provides support which aids the exerciser in holding the hand weight but does not constrict the hand and thereby hinder blood flow throughout the hand. In U.S. Pat. No. 4,351,526 to L. Schwartz, a simple strap is disclosed with respect to the hand weight. In U.S. Pat. No. 4,627,618 by L. Schwartz, a sleeve with a three-sided rigid member therein is disclosed which essentially forms the strap. The three-sided rigid member is not connected to an elongate rigid member having a predetermined weight, but the sleeve is connected to it. This strap does not hinder blood flow to the hand since the sleeve is made out of a material which can be stretched when the hand, for instance, is squeezed together to grip the elongate rigid member. However, because there is a three-sided rigid member within the sleeve, the sleeve does not conform well to the back of the hand when expanded. In addition, because the three-sided rigid member is not connected to the elongate rigid member, the sleeve does not have structural support at its points of connection to the elongate rigid member. This can contribute to the hand weight moving more than desired on the exerciser's hand during vigorous exercise.

The present invention provides a hand weight that has an expandable strap. The expandable strap is supported at the points it connects to a weighted portion which is gripped by the hand of an exerciser, yet is conformable to the back of the hand.

SUMMARY OF THE INVENTION

The present invention pertains to an apparatus for exercising. The apparatus comprises a first portion having a predetermined weight. The first portion is grippable by a hand and has a first end and a second end. The apparatus is also comprised of N second essentially rigid portions connected to the first portion such that N openings are defined by the first portion and the N second portions, where $N \geqq 1$. The N openings are each capable of receiving a hand in a manner that essentially does not affect blood pressure or blood circulation through the hand. The first portion is disposed with respect to the front of the hand and the second portion is disposed with respect to the back of the hand. In a preferred embodiment, $N=1$.

An exerciser uses the apparatus by placing his hand through the opening and gripping the first portion. When, for instance, the exerciser swings his arm, the second portion that is disposed with respect to the back of the hand facilitates the exerciser maintaining a grip on the first portion without having to grip it tightly while moving the arm during exercise.

BRIEF DESCRIPTION OF THE DRAWINGS

In the accompanying drawing, the preferred embodiments of the invention and preferred methods of practicing the invention are illustrated in which.

DESCRIPTION OF THE PREFERRED EMBODIMENT

Figure 1:
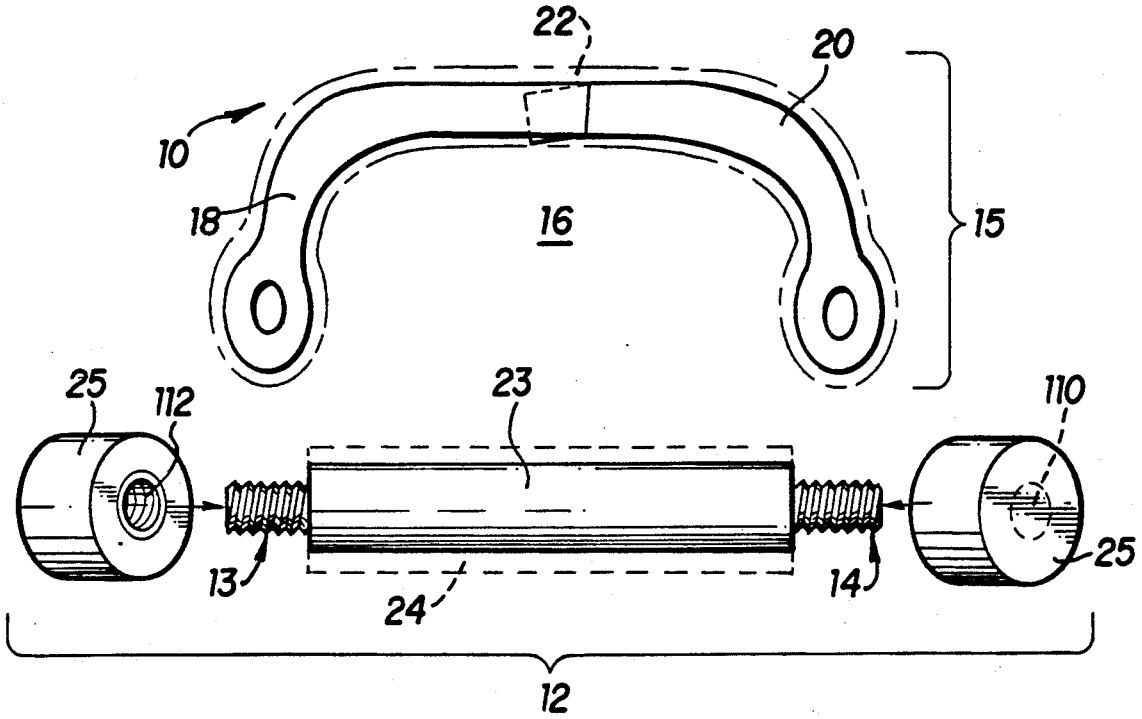
FIG. 1 is an exploded view of an apparatus for exercising.
Figure 2:
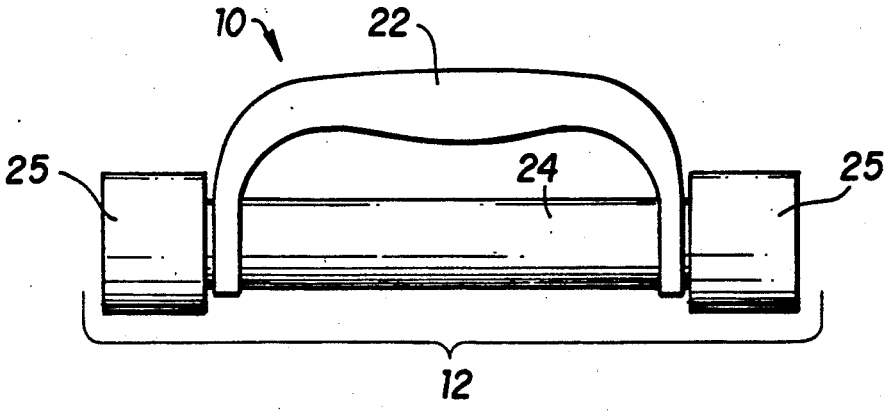
FIG. 2 is a perspective view of the apparatus.

Referring now to the drawings wherein like reference numerals refer to similar or identical parts throughout the several views and more specifically to FIG. 1 thereof, there is shown an apparatus 10 for exercising with respect to a hand. The apparatus 10 comprises a first portion 12 having a predetermined weight. The first portion 12 is grippable by the hand and has a first end 13 and a second end 14. Preferably, the first portion 12 is rigid and has weighted ends. The first portion 12 is preferably comprised of a rigid member 23 and a second sleeve 24 positioned about the rigid member 23. Preferably, the first end 13 is threaded and the second end 14 is threaded. Weights 25 are threadingly attached thereto.

Additionally, the apparatus 10 is comprised of a second essentially rigid portion 15 connected to the first portion 12 such that an opening 16 is defined by the first portion 12 and the second portion 15 which receives the hand in a manner that essentially does not limit blood circulation through the hand. The second portion 15 is preferably comprised of a first element 18 connected to the first end 13 and extending therefrom and a second element 20 connected to the second end 14 and extending therefrom. Moreover, the second portion 15 is comprised of a sleeve 22 made of a soft material which receives the first element 18 and a second element 20 and maintains them therein. The first portion 12 is disposed with respect to the front of the hand and the second portion 15 is disposed with respect to the back of the hand. Preferably, the second portion 15 is connected to the first portion 12 in proximity to the first end 13 and the second end 14 with the opening 16 therebetween. Preferably, the first sleeve 22 is connected to the rigid member 23 in proximity to the first end 13 and second end 14, respectively.

The second portion 15 essentially forms a strap that enables a exerciser to better integrate with the apparatus 10 to achieve desired physiological benefits from exercising with the apparatus 10. The straps make possible the use of steady state (endurance oriented, rhythmic, aerobic activity) that can benefit both the skeletal muscle and the cardiovascular system, producing training effects which are not possible with conventional exercise equipment or technique.

The parts can be of various sizes and assembled to suit a particular exerciser so as to provide the proper amount of gripping action on the hand to permit their being used with the hand in fully relaxed position yet not apply so much pressure that blood circulation is in any way adversely affected.

In the operation of the invention, the exerciser inserts his hand through the opening 16 and grips the rigid member 23 via the second sleeve 24. The opening 16 is of a size such that it fits in it firmly so, for instance, it will not fall off the hand when the hand is in a relaxed position, but not so firmly that circulation or blood pressure of the exerciser is affected by it. Moreover, with the first rigid element 18 and second rigid element 20 connected together through the first hole 26 and second hole 28, respectively, the hand is free to increase in size, for instance, when squeezing the rigid member 23 because the first rigid element 18 and second rigid element 20 are free to move with respect to each other. They are held in place with respect to each other across the back of the hand by the first sleeve 22. By being connected through the first sleeve 22, the first rigid element 18 and the second rigid element 20 provide support to the first sleeve 22 but not in a constraining fashion with respect to the hand of the exerciser.

Figure 3:
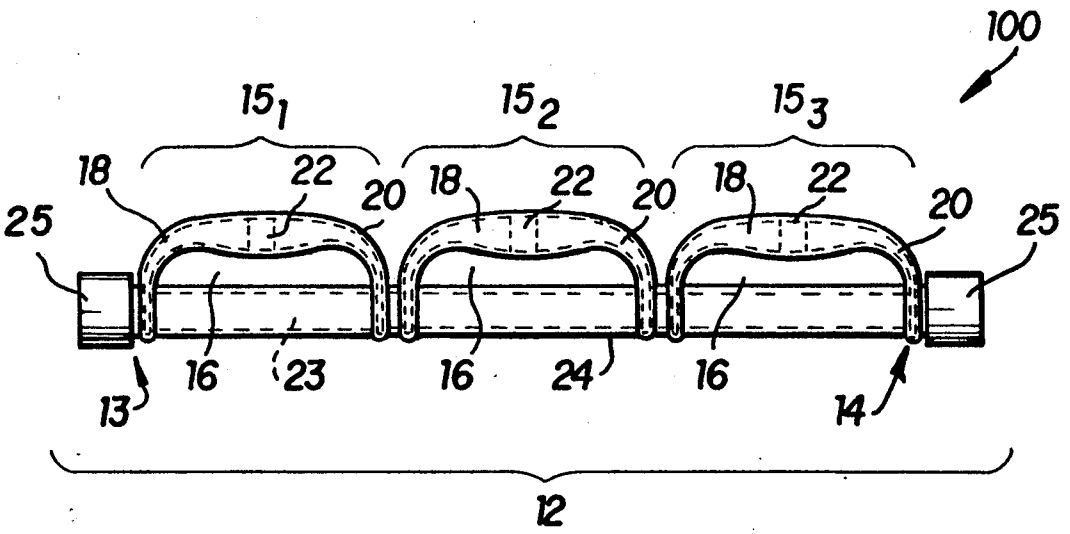
FIG. 3 is a perspective view of an alternative embodiment of the apparatus.

In an alternative embodiment, as shown in FIG. 3, there is an apparatus 100 for exercising. The apparatus 100 is comprised of a first portion 12 having a predetermined weight. The first portion is grippable by a hand and has a first end 13 and a second end 14. The apparatus 100 is also comprised of N second essentially rigid portions 15 connected to the first portion 12 such that N openings 16 are defined by the first portion 12 and the N second portions 15, where $N \geqq 1$. The N openings 16 are each capable of receiving a hand in a manner that essentially does not limit blood circulation through the hand. The first portion 12 is disposed with respect to the front of the hand and the second portion 15 is disposed with respect to the back of a hand. Preferably, the first portion 12 has weighted ends 25 and is comprised of a rigid member 23 and a second sleeve made out of a soft resilient material positioned about the rigid member 23.

Each second portion 15 is preferably rotatable with respect to the first portion 12 and is comprised of a first rigid element 18 connected to the first portion 12 and extending therefrom, and a second rigid element 20 connected to the first portion 12 and extending therefrom. The second portion 15 is also preferably comprised of a first sleeve 22 made of a soft resilient material which receives the first element 18 and a second element 20 and maintains them therein.

The apparatus 100 can be used for a multitude of exercises. The focus of these exercises can be for overall health benefits or for specific muscle development with respect to a given sport. For instance, to strengthen the muscles used during batting, a first portion 12 having a length capable of supporting three second essentially rigid portions 15 (three straps) connected to the first portion 12 is used. The exerciser then grips the first portion through the two second essentially rigid portions 15 closest to the body of the exerciser when the apparatus 100 extends perpendicular from the exerciser. By next swinging the apparatus 100 as though it was a bat, the exerciser can strengthen the muscles used for batting. The exerciser can choose the desired weight to place at the outside end of a first portion 12 and can choose a minimal weight for the inside end of the first portion 12 to maximize the feeling that the apparatus 100 is a bat. The fact that the second essentially rigid portions 15 are along side each other better simulates an actual batting grip when the exerciser grips the apparatus 100. The fact that the second essentially rigid portions enable the exerciser to swing the apparatus 100 without gripping the first portion 12, but with fingers outspread, enables the exerciser to swing the apparatus 100 for long periods of time, i.e., typically 2–20 minutes and even more if they wish, without having to stop because the exerciser's fingers have become sore from gripping the first portion 12. In this way, the exerciser also can use the exercise of swinging the apparatus 100 as though it was bat for aerobic exercise.

Additionally, it is the fact that the second essentially rigid portions 15 are connected to the first portion 12 which enables the apparatus 100 to be used again and again without the second essentially rigid portion 15 tearing away from the first portion 12. It is this connection that provides for structural support for the apparatus 100 to withstand over time the centrifugal force at the connection which is present during the swinging of the apparatus 100.

The apparatus 100 enables the exerciser to train the trunk, low back and abdominal musculature while the exerciser remains in the erect posture and while the legs and arms are active as well. Thus this apparatus 100 makes possible a novel exercise technique which produces effects otherwise not achievable.

The three strapped version of the apparatus 100 enjoys special usefulness. As was indicated above, when weighted assymmetrically, the three-strapped apparatus 100 of this particular length has been found to be ideal for training the body while practicing specific movements associated with sports. Thus, such an embodiment which can be loaded with a variety of end-weights can serve as a weighted bat or golf club and used to perfect technique in swinging movements while training the subject's cardiovascular system (prolonged exercise) as well as the subject s strength/endurance (the capacity to apply great force repetitively to the benefit of the exerciser's musculature as well as the organs that serve the cardiorespiratory functions). These exercises also enhance the subject's ability to perform in those sports from which these movements are taken.

Limiting the length of the apparatus 100 to the length of three straps, makes the equipment safer to use, while preserving the 'sense' of the distribution of the weight that approximates the weight distribution characteristic of bats, clubs, etc. The three strapped embodiment, without links 106 (see FIGS. 7 and 8 described below), is especially useful because the links 106 would make conventional gripping of bats and clubs impossible, because they preclude the approximation of the hands which is characteristic of the sport.

Figure 4:
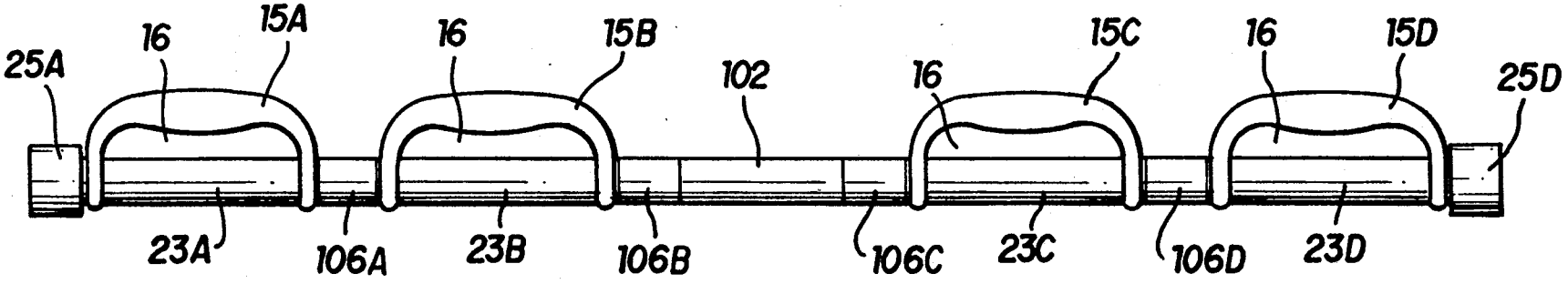
FIG. 4 is a side view of an apparatus for exercising with hand weights.
Figure 5:
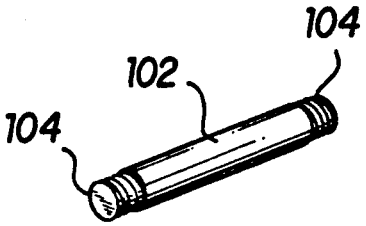
FIG. 5 is a perspective view of a spacer.
Figure 6:
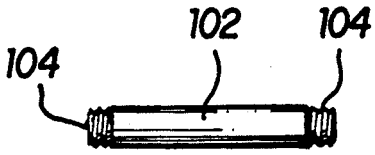
FIG. 6 is a side view of a spacer.
Figure 7:
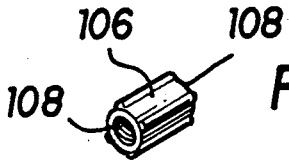
FIG. 7 is a perspective view of a link.

Referring to FIG. 4, there is shown a side view of an apparatus 200 for use during exercise with hand weights. The apparatus 200 comprises a spacer 102 as shown in FIG. 5 and FIG. 6. The spacer is grippable by a hand and has each end 104 being a male threaded portion. The apparatus 200 is also comprised of a link 106, as shown in FIG. 7. Each end 108 of the link 106 is a female threaded portion able to receive the male threaded portion of the spacer 102. There is also a rigid member 23 grippable by the hand and having a first end 13 and a second end 14. The first end 13 and the second end 14 of the rigid member 23 are each a male threaded portion that can be received by the female threaded portion of the link 106. (Shown in FIG. 1). There is a pair of weighted ends 25 each having a female threaded portion able to receive the male threaded portion of the spacer 102 or the rigid member 23 as shown in FIG. 1. There is also a second essentially rigid portion 15 connected to the rigid member 23 such that an opening 16 is defined by the rigid member 23 and the second portion 15 which receives the hand in a manner that essentially does not affect blood pressure or blood circulation through the hand. The rigid member 23 is disposed with respect to the front of the hand and the second portion 15 is disposed with respect to the back of the hand.

The spacer 102, links 106, weights 25, rigid members 23 and second portions 15 can be combined together in various desired sequences to accommodate various exercises with hand weights having corresponding lengths and weights. Preferably, there is one spacer 102, four links 106, a pair of weights 25, four rigid members 23 and four second portions 25 as shown in FIG. 4. They are connected such that each weighted end 25*a*, 25*d* is connected to a rigid member 23*a*, 23*d*, respectively. A second portion 15*a*, 15*d* is connected to the rigid member 23*a*, 23*d*, respectively, as is a link 106*a*, 106*d* through the end 14 of the rigid member 23*a*, 23*d*, respectively, not connected to the respective weighted end 25. The other end of the link 106*a* is connected to another rigid member 23*b*. To the rigid member 23*b* is connected a second portion 15*b* and another link 106*b*. The spacer 102 is connected to the link 106*b* and to a link 106*c*. The link 106*c* is connected to the rigid end 23*c* and to the link 106*d* at its respective ends. There is a second portion 15*c* that is connected to the rigid member 23*c*. The link 106*d* has connected to it a rigid member 23*d*. The rigid member 23*d* also has connected to it a weighted end 25 and a second portion 15*d*. Of course, any number of links, rigid members, second portions, and spacers can be used, and, additionally, wherever there are male threaded portions, they can be substituted for female portions and whenever there are female portions they can be substituted for male portions in order to obtain the various releasable connections between the elements.

The length of the apparatus can vary from the length of two straps to perhaps the length of 7 or 8 straps. For example, with an apparatus 200 having a given weight composed of 6 linked straps (not shown), either the outermost (straps #1 and #6) may be employed during exercise, or straps #2 and #5 can be used. Each variation creates a different challenge for the exerciser even though the total weight remains identical. Since the innermost handles, i.e., #3 and #4, cannot be comfortably employed during exercise, the central space is filled by a threaded solid rod spacer 102 which is less expensive but which serves to separate the exerciser s hands by the necessary fixed distance required by the design of the particular exercise.

Figure 8:
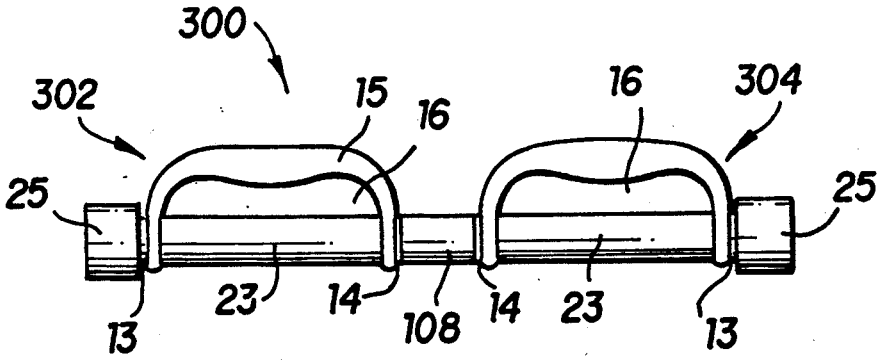
FIG. 8 is a perspective view of another embodiment of the apparatus.

Alternatively, there can be an apparatus 300 for use during exercise with hand weights, as shown in FIG. 8. The apparatus comprises a link 108 having each end 106 being a female threaded portion. The apparatus 300 is also comprised of a first dumbbell 302 and a second dumbbell 304. Each dumbbell is comprised of a rigid member 23 grippable by the hand and having a first end 13 and a second end 14. The rigid member 23 has each end being a male threaded portion with each second end 14 received by the female portion of the link 106. Each dumbbell is also comprised of a second essentially rigid portion 15 connected to the rigid member 23 such that an opening 16 is defined by the rigid member 23 and the second essentially rigid portion 15 which receives the hand in a manner that essentially does not limit blood circulation through the hand. The rigid member 23 is disposed with respect to the front of the hand and the second essentially rigid portion 15 is disposed with respect to the back of the hand. Additionally, there are a pair of weighted ends 25 each having a female threaded portion 110 that receives each first end 13 of the rigid member 23 of the first dumbbell 302 and second dumbbell 304.

An apparatus 100, an apparatus 200 or an apparatus 300 of varying length can be used in a variety of combined exercises (including arms, legs, trunk) which emphasize muscle groups that are not generally activated in conventional exercise or sport. The fixed position of the hands makes this upper body component markedly different from those exercises which, for example, employ conventional handweights and activate the arms separately. For example, the apparatuses with varied lengths and with varying weights can be used as an adjunct to walking, during which, by the nature of the upper body movements involved, calls the trunk and abdominal musculature uniquely into play. Standard weight lifting techniques usually preclude twisting movements of the trunk. These apparatuses are ideal for the practice of such movements which are essential to most forms of athletic performance. When such movements are performed with the hands fixed at some distance from one another, along with such torsion movements of the trunk and some flexion of the knees, the exerciser enjoys the benefits of simultaneous activity of most of the body's musculature.

Although the invention has been described in detail in the foregoing embodiments for the purpose of illustration, it is to be understood that such detail is solely for that purpose and that variations can be made therein by those skilled in the art without departing from the spirit and scope of the invention except as it may be described by the following claims.

What is claimed is:

1. An apparatus for exercising that is used with a hand comprising:

a first portion having a predetermined weight, said first portion grippable by the hand and having a first end and a second end;

a first rigid element rotatably connected to the first end and extending therefrom;

a second rigid element rotatably connected to the second end and extending therefrom but free to move with respect to said first rigid element; and a first sleeve rotatably connected to the first portion, said first sleeve made of a soft resilient material which receives the first element and the second element and maintains them therein such that an opening is defined by the first portion and the first sleeve which receives the hand in a manner that essentially does not limit blood circulation through the hand, said first portion disposed with respect to the front of the hand and said second portion disposed with respect to the back of the hand, said first sleeve conformable with the back of the hand by way of the first sleeve stretching and the first and second rigid elements free to move the respect to each other and the sleeve when the hand is inserted into the opening.

2. An apparatus as described in claim 1 wherein the first sleeve is connected to the first portion in proximity to the first end and the second end.

3. An apparatus as described in claim 2 wherein the the first portion has weighted ends.

4. An apparatus as described in claim 3 wherein the first portion is comprised of a rigid member and a second sleeve made out of a soft resilient material positioned about the rigid member.

5. An apparatus as described in claim 4 wherein the first end is threaded and the second end is threaded, and weights are threadingly attached thereto.

6. An apparatus as described in claim 5 wherein the first sleeve is connected to the rigid member in proximity to the first end and the second end, respectively.

7. An apparatus for exercising comprising:

a first portion having a predetermined weight, said first portion grippable by a hand and having a first end and a second end;

N second portions connected to the first portion such that N openings are defined by the first portion and the N second portions, where $N \geqq 1$, said N openings each capable of receiving a hand in a manner that essentially does not limit blood circulation through the hand, said first portion disposed with respect to the front of the hand and said second portion disposed with respect to the back of the hand, each second portion comprised of a first rigid element rotatably connected to the first portion and extending therefrom, and a second rigid element rotatably connected to the first portion and extending therefrom but free to move with respect to the first rigid element, and a first sleeve rotatably connected to the first portion, said first sleeve made of a soft resilient material which receives the first element and the second element and maintains them therein, said first sleeve conformable with the back of the hand by way of the first sleeve stretching and the first and second rigid elements free to move with respect to each other and the sleeve when the hand is inserted into the opening.

8. An apparatus as described in claim 7 wherein the the first portion has weighted ends.

9. An apparatus as described in claim 8 wherein the first portion is comprised of a rigid member and a second sleeve made out of a soft resilient material positioned about the rigid member.

10. An apparatus for use during exercise with hand weights comprising:

a spacer grippable by a hand and having each end being a male threaded portion;

a link having each end being a female threaded portion able to receive said male threaded portion of the spacer;

a rigid member grippable by the hand and having a first end and a second end, said rigid member having each end being a male threaded portion that can be received by said female portion of the link;

a second portion connected to the rigid member such that an opening is defined by the rigid member and the second portion which receives the hand in a manner that essentially does not limit blood circulation through the hand, said rigid member disposed with respect to the front of the hand and said second portion disposed with respect to the back of the hand, said second portion comprised of a first rigid elements rotatably connected to the rigid member and extending therefrom, and a second rigid element rotatably connected to the rigid member and extending therefrom but free to move with respect to the first rigid element, and a first sleeve made of a soft resilient material which receives the first element and the second element and maintains them therein, said first sleeve conformable with the back of the hand by way of the first sleeve stretching and the first and second rigid elements free to move with respect to each other and the sleeve when the hand is inserted into the opening; and a pair of weighted ends each having a female threaded portion able to receive said male threaded portions of the spacer or the rigid member.

11. An apparatus for sue during exercise with hand weights comprising:

a link having each end being a female threaded portion;

a first and second dumbbell, each dumbbell comprised of:

a rigid member grippable by the hand and having a first end and a second end, said rigid member having each end being a male threaded portion with each second end received by said female portion of the link;

a second portion connected to the rigid member such that an opening is defined by the rigid member and the second portion which receives the hand in a manner that essentially does not limit blood circulation through the hand, said rigid member disposed with respect to the front of the hand and said second portion disposed with respect to the back of the hand, said second portion comprised of a first rigid element rotatably connected to the rigid member and extending therefrom, and a second rigid element rotatably connected to the rigid member and extending therefrom but free to move with respect to the first rigid element, and a first sleeve made of a soft resilient material which receives the first element and the second element and maintains them therein, said first sleeve conformable with the back of the hand by way of the first sleeve stretching and the first and second rigid elements free to move with respect to each other and the sleeve when the hand is inserted into the opening; and a pair of weighted ends each having a female threaded portion that receives each first end of the rigid member of the first and second dumbbells.

* * * * *